US006220279B1

(12) United States Patent
Segien

(10) Patent No.: US 6,220,279 B1
(45) Date of Patent: Apr. 24, 2001

(54) FAUCET ASSEMBLY

(75) Inventor: Donald J. Segien, Chatsworth, CA (US)

(73) Assignee: Emhart Inc., Newark, DE (US)

( * ) Notice: Subject to any disclaimer, the term of this patent is extended or adjusted under 35 U.S.C. 154(b) by 0 days.

(21) Appl. No.: 08/961,772

(22) Filed: Oct. 31, 1997

(51) Int. Cl.[7] ..... E03C 1/04

(52) U.S. Cl. ..... 137/359; 4/676; 137/801; 285/193

(58) Field of Search ..... 4/676; 137/359, 137/801; 285/193

(56) References Cited

U.S. PATENT DOCUMENTS

| | | | | |
|---|---|---|---|---|
| Re. 30,559 | | 3/1981 | Schmitt . | |
| 1,333,826 | | 3/1920 | Yeiser et al. . | |
| 3,229,710 | | 1/1966 | Keller, III . | |
| 4,026,328 | | 5/1977 | Nelson . | |
| 4,186,761 | * | 2/1980 | Guarnieri | 137/359 X |
| 4,463,460 | | 8/1984 | Arnold et al. . | |
| 4,852,192 | | 8/1989 | Viegener . | |
| 4,856,122 | | 8/1989 | Pilolla . | |
| 5,135,022 | | 8/1992 | Kovey et al. . | |
| 5,232,008 | | 8/1993 | Jeffress et al. . | |
| 5,865,211 | * | 2/1999 | Thomas | 137/359 |

* cited by examiner

*Primary Examiner*—Gerald A. Michalsky
(74) *Attorney, Agent, or Firm*—Harold Weinstein; John D. Del Ponti

(57) ABSTRACT

A faucet assembly 30 includes an underbody 36 having end bodies 40 and 42 which are linked by conduits 44 with a center body 38, and further includes a spout 32 and a attached shank 34, all of which are to be assembled with a deck 56. Portions of the upper ends of the end bodies 40 and 42 are each formed with an annular groove 72 which extend through holes 60 and 62 in the deck 56. A pair of trim flanges 48 and 52 are each formed with a platform 160 having an opening 162 extending therethrough which facilitates the positioning of portions of the platform within the annular groove 72 to retain the underbody 36 with the deck 56. Another hole 58 is formed in the deck 56 above the assembled center body 38 and is formed with an axial passage 76 for receipt of the shank 34. With the bottom of the spout 32 resting on the top of the deck 56, a threaded lower section 110 of the shank 34 extends from the bottom of the center body 38 where a fastening nut 54 secures the shank and the spout with the center body and with the deck.

16 Claims, 7 Drawing Sheets

FAUCET ASSEMBLY

BACKGROUND OF THE INVENTION

This invention relates to a faucet assembly, and particularly relates to structure of components of a faucet assembly which facilitate the rapid and easy installation of the components with a counter top or deck.

One type of currently-available faucet assembly is referred to as a "widespread" faucet and includes a spout and a pair of valve handles which are spaced from each other on a support platform such as a counter top or a deck. The faucet assembly also includes an underbody which is formed by a pair of spaced end bodies which are threaded on the exterior thereof and which are linked to a center body by a pair of fluid conduits. The center body is formed with a chamber which communicates with the conduits and with an opening formed in the top of thereof. The underbody is located beneath the deck. A pair of valves are located in respective ones of the end bodies with each valve having a stem extending above the top of the respective end body, and above the deck for assembly with a respective one of the valve handles. Hot and cold water enters at the bottom of the end bodies and the handles are used to control the valves and allow water to flow to the center body and from the spout in a conventional manner.

The faucet assembly includes a shank which has an axial opening therethrough and a threaded exterior from a first end nearly to a second end thereof. The first end of the shank is threadedly secured into a threaded opening in the bottom of the spout. The second end of the shank is reduced in size and has an O-ring mounted on the exterior thereof for eventual insertion into the top opening of the center body in communication with the chamber thereof.

Three spaced holes are formed through the deck for eventual receipt, from the bottom of the deck, of upper portions of the spaced end bodies and, from the top of the deck, the shank of the spout. The shank of the spout is initially positioned, from the top of the deck, through a center one of the three holes in the deck together with washers and a decorative flange on the top of the deck and a slotted washer at the underside of the deck. A locknut is threadedly attached to the threaded exterior of the shank, near the second end thereof, which extends below the deck and is tightened to secure the spout and the shank with the deck. In this arrangement, the reduced second end of the shank with the O-ring is exposed below the deck awaiting assembly of the other component parts of the faucet assembly.

A valve is assembled within each end body with the stem of the valve extending above the top of the end body. A locknut and a washer are assembled about the threaded exterior of each end body, near the bottom of the threaded exterior just above the conduit which is assembled therewith. The underbody is manipulated to move the upper ends of the end bodies, from the underside of the deck, through the respective holes in the deck. Also, the second end of the shank, with the O-ring, is guided into the top opening of the center body. Prior to, and during, this manipulation of the underbody, care must be exercised to insure that the exposed second end of the shank and the O-ring are not damaged. From the top of the deck, a washer and an internally threaded trim flange are positioned over the extended stem and the top of the exterior threaded portion of the end body.

For proper assembly of the faucet assembly, the top of each stem must be located a prescribed distance above the top of the deck, when the valve is in the closed position. To properly locate each stem as necessary, the underbody has to be held while measurements are made to insure that the stem height is appropriate. This is a tedious maneuver at best and necessitates movement of the second end of the shank within the opening of the center body during the adjustment period.

Once the desired height of the stems is obtained, and with the threaded trim flanges being in place, the locknuts on the bottom of the threaded exterior of the end bodies are threadedly moved upward to locate the respective washers against the underside of the deck and tightened in that location to firmly secure the faucet assembly with the deck.

In view of the techniques employed in assembling the faucet assembly as described above, there is a need for a faucet assembly having component structure which eliminates concern for damage to the second end of the shank, and facilitates relatively easy installation of the faucet assembly with the height stems being readily attainable without tedious manipulations of the components.

SUMMARY OF THE INVENTION

It is, therefore, an object of this invention to provide a faucet assembly having structure which facilitates relative easy and efficient assembly of components thereof with a deck.

Another object of this invention is to provide a faucet assembly having structure which facilitates the attainment of precisely and quickly locating, mounting and securing components thereof with a deck.

Still another object of this invention is to provide a faucet assembly having structure which facilitates the assembly of components thereof in such a manner as to minimize any opportunity for damage to the components during the assembly process.

With these and other objects in mind, this invention contemplates a faucet assembly for assembly with a deck which includes a spout, a center body and a shank secured at one end thereof to the spout and extending axially through an axial passage of the center body. Means are provided for securing the spout, the center body and the shank in assembly with the deck.

This invention further contemplates a faucet assembly for assembly with a deck including an end body formed with a first threadless fastening structure and an element formed with a second threadless fastening structure. The first and second fastening structures are formed to be cooperative and complementary when assembled to retain the end body and the element together in a threadless manner on a first side of the deck. Means are provided for securing the end body on a second side of the deck opposite the first side thereof.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
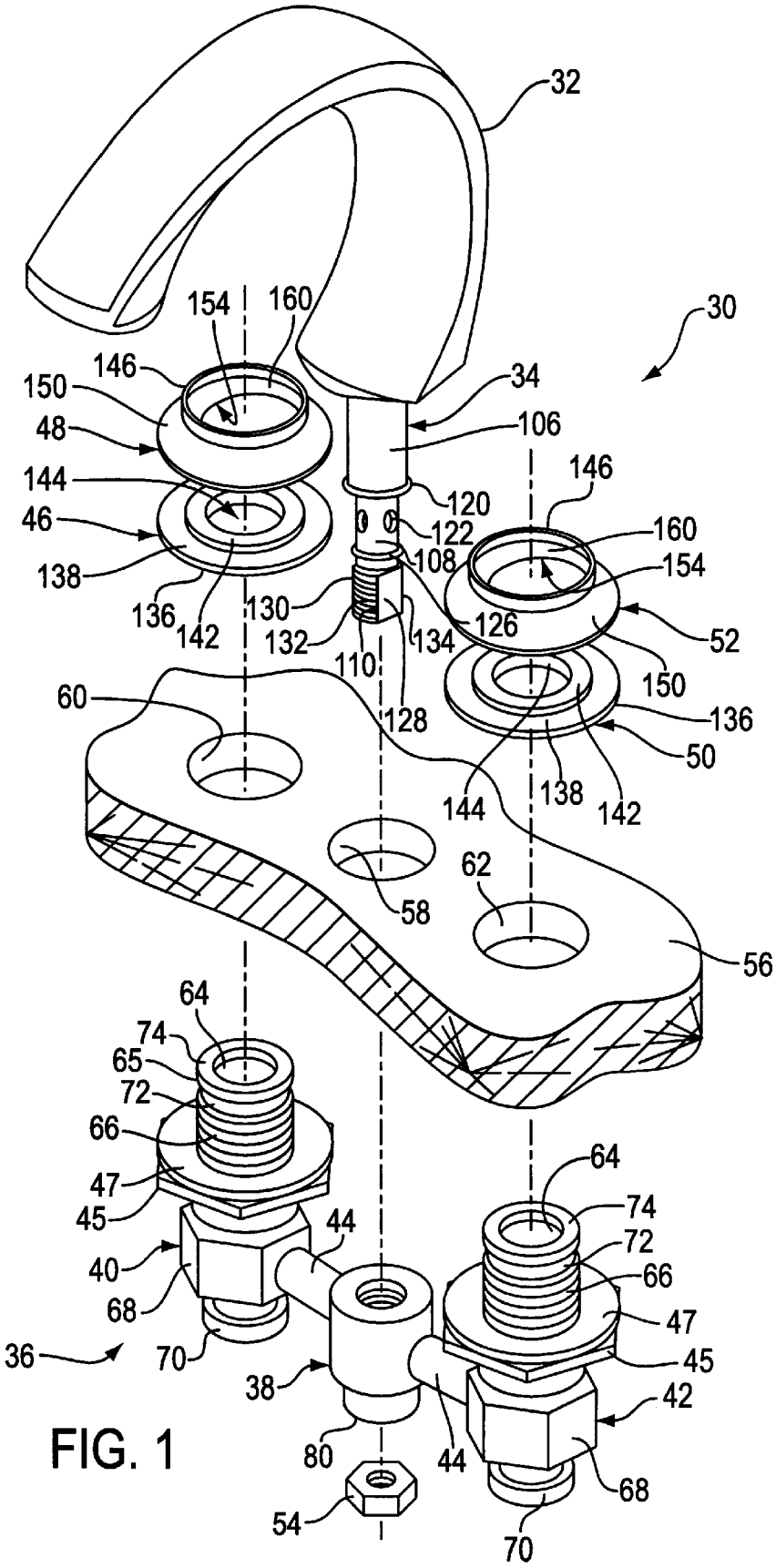
FIG. 1 is an exploded perspective view showing components of a faucet assembly in accordance with certain principles of the invention.
Figure 2:
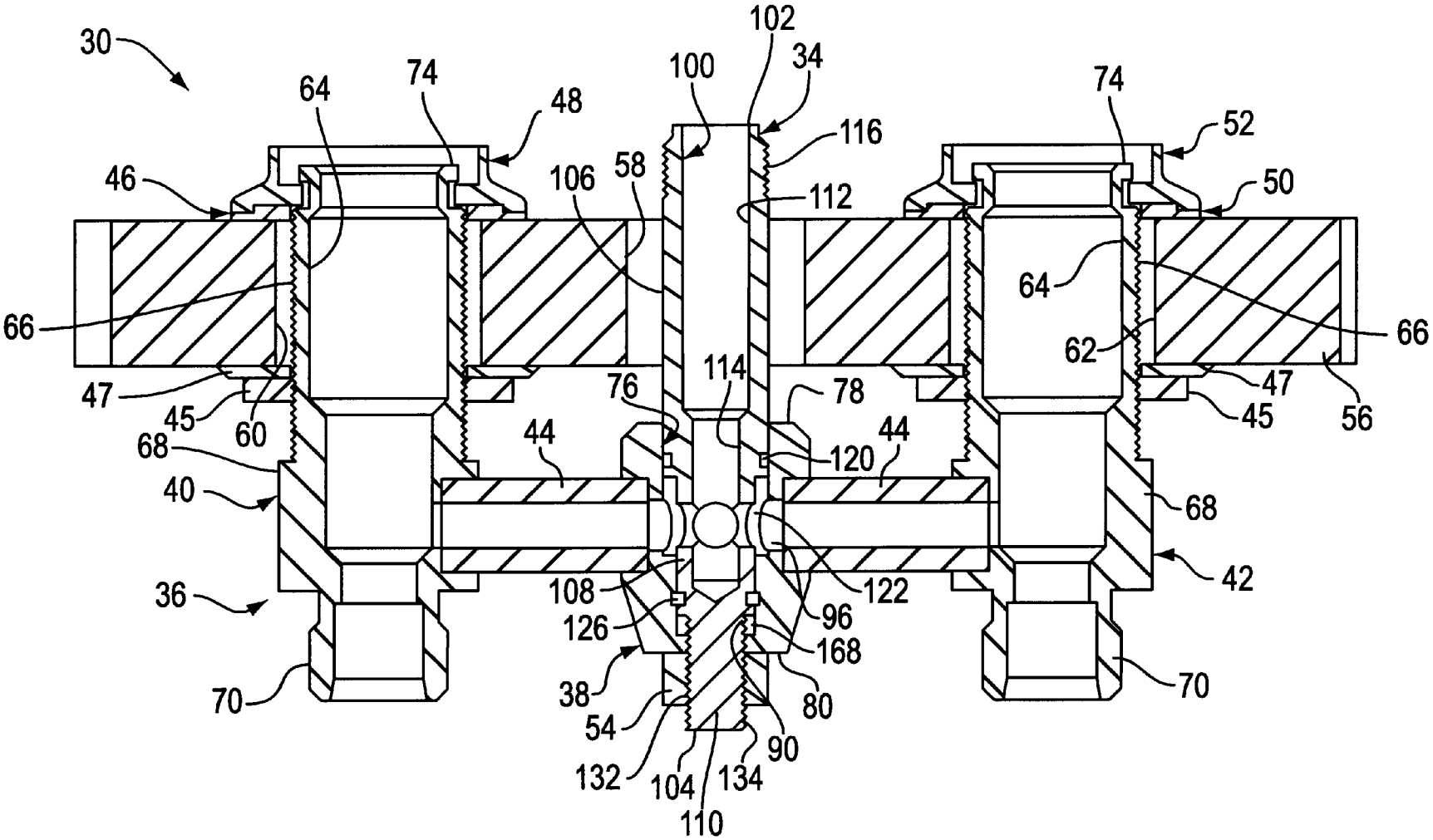
FIG. 2 is a sectional view showing the components of FIG. 1 in assembly in accordance with certain principles of the invention.

Referring to FIGS. 1 and 2, a faucet assembly 30 includes a spout 32 and a shank 34 attached to the bottom of the spout. The faucet assembly 30 also includes an underbody 36 (FIG. 3) having a center body 38, a first end body 40, a second body 42 and a pair of conduits 44 for providing fluid communications between the end bodies and the center body. Also included are a pair of lock nuts 45 and a pair of washers 47. The faucet assembly 30 further includes a first retainer element 46, a first trim flange 48, a second retainer element 50, a second trim flange 52 and a fastener nut 54. Also shown is a faucet assembly support such as, for example, a portion of the top of a counter top, referred to as a deck 56. The deck 56 is formed with holes therethrough identified as a center hole 58 and two side holes 60 and 62 located and equally spaced on opposite sides of the center hole.

Figure 3:
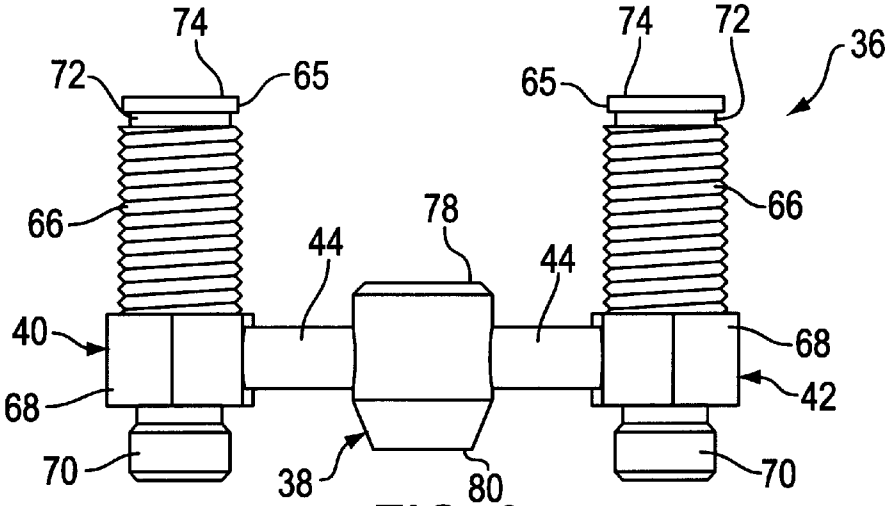
FIG. 3 is a front view of an underbody of the faucet assembly of FIG. 1 in accordance with certain principles of the invention.

Referring to FIG. 3, each of the end bodies 40 and 42 are formed with an axial passage 64 (FIGS. 1 and 12 through 15) which extends through the body from a first axial end to a second axial end thereof. Each of the end bodies 40 and 42 are formed with an axially short top section 65, a threaded upper section 66, a hexagonal intermediate section 68 and a lower section 70. An annular groove 72 is formed around each of the end bodies 40 and 42 between the upper section 66 and the top section 65 which is formed with a top surface 74. The top section 65 is formed with a prescribed diameter and the annular groove 72 is formed with a diameter which is less than the prescribed diameter, with both diameters being measured with respect to the axis of the respective end body 40 or 42.

Figure 6:
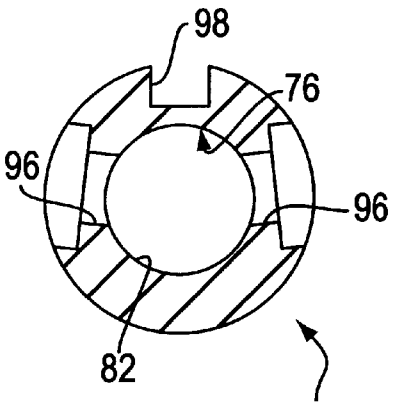
FIG. 6 is a sectional view showing features of the center body of FIG. 4.
Figure 5:
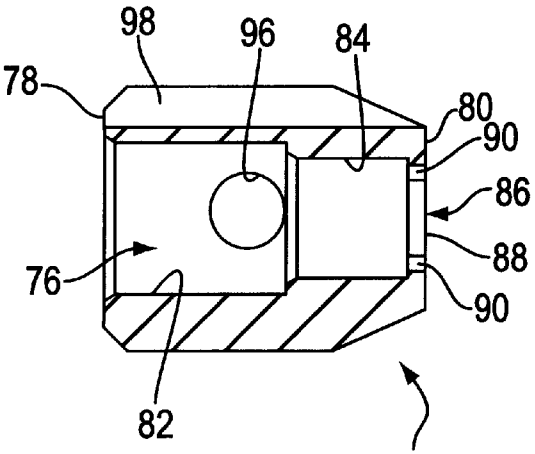
FIG. 5 is a sectional view showing features of the center body of FIG. 4 in accordance with certain principles of the invention.
Figure 4:
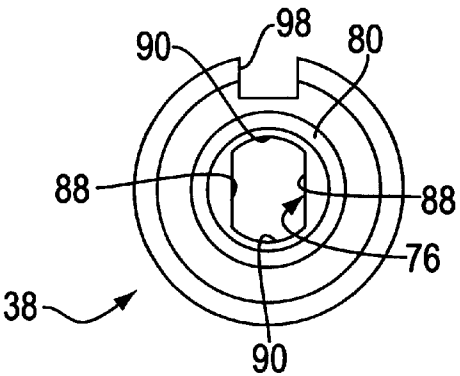
FIG. 4 is a end view showing a center body of the underbody of FIG. 3 in accordance with certain principles of the invention.

Referring to FIGS. 4, 5 and 6, the center body 38 is formed with an axial passage 76 which extends therethrough from a first axial end 78 to a second axial end 80. The passage 76 is formed with a first cylindrical chamber 82 of a prescribed diameter extending axially inward from the first end 78, a second cylindrical chamber 84 at a diameter smaller than the prescribed diameter, and a four-sided opening 86 at the second end 80. The opening 86 is formed with two opposing, spaced flat sides 88 and 90, and with two opposing, spaced rounded sides 92 and 94. The center body 38 is formed with a pair of transaxial passages 96 which communicate with the axial passage 76. An axially-aligned notch 98 is formed on the exterior of the central body 38 to provide an open clearance for a drain stem (not shown).

Figure 7:
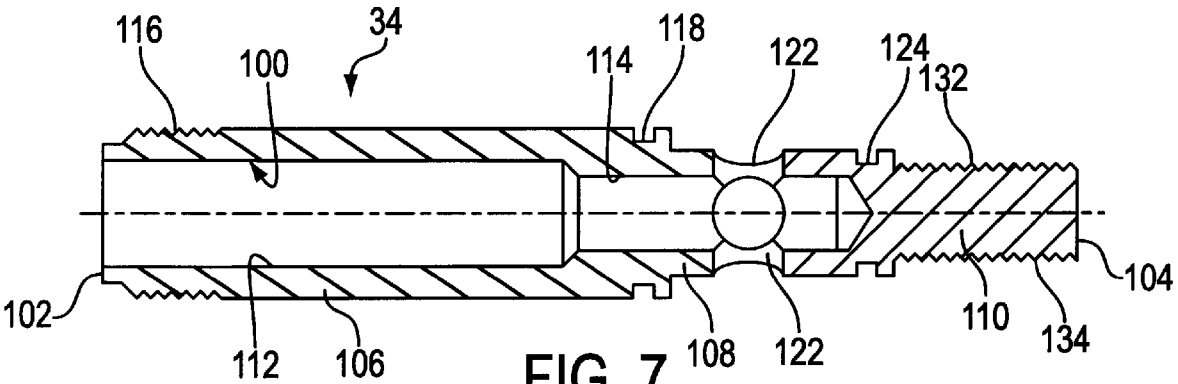
FIG. 7 is a sectional view showing a shank in accordance with certain principles of the invention.

Referring to FIG. 7, the shank 34 is formed with an axial opening 100 which extends from a first axial end 102 toward, but not through, a second axial end 104, which is closed. The shank 34 is formed with a first section 106 which is cylindrical in external shape and which extends from the first end 102 with a prescribed diameter. An intermediate or second section 108 of the shank 34 extends from the first section 106 and is formed with an external diameter which is less than the prescribed diameter. A third section 110 extends axially from the second section 108 to the second end 104 of the shank 34.

Figure 15:
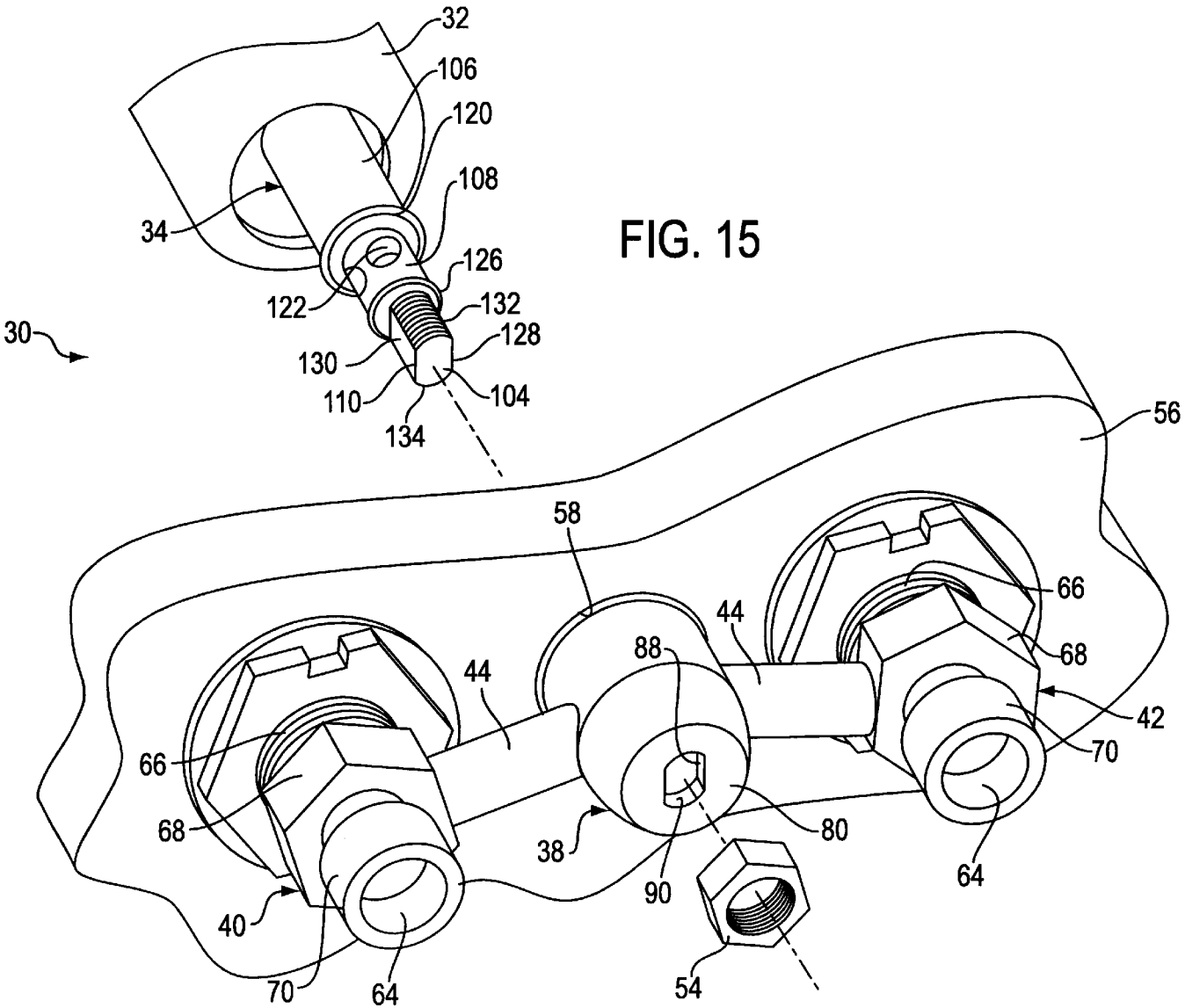
FIG. 15 is a perspective view showing the shank in assembly with a spout and aligned with the opening of the center body for insertion therein.

The opening 100 is formed by a first chamber 112 of a prescribed diameter and a second chamber 114 of a diameter less than the prescribed diameter of the first chamber. The first section 106 of the shank is formed externally with threads 116 near the first end 102, and an annular groove 118 near an inboard end of the first section for receiving an O-ring 120 (FIGS. 1, 2 and 15). A plurality of transaxial passages 122 are formed through the shank 34 and communicate with the chamber 114. The exterior of the second section 108 is formed with an annular groove 124 for supporting an O-ring 126 (FIGS. 1, 2 and 15). As shown in FIGS. 1 and 15, the exterior of the third section 110 of the shank 34 is a formed in a four-sided cross-sectional shape with two flat surfaces 128 and 130 on opposite sides thereof, and two rounded sides 132 and 134 on the remaining opposite sides thereof. The rounded sides 132 and 134 are formed with threads. The four-sided cross-sectional shape of the third section 110 is complementary to the four-sided opening 86 formed in the end 80 of the center body 38.

Figure 8:
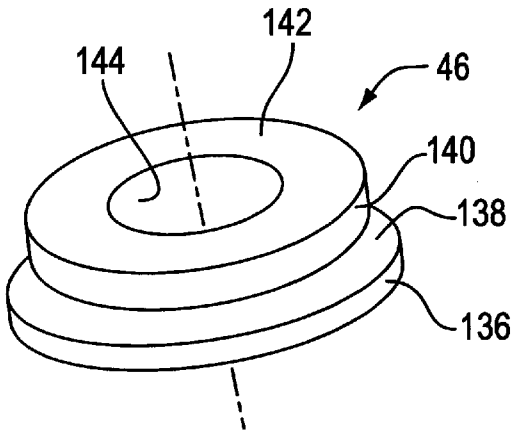
FIG. 8 is a perspective showing a retainer in accordance with certain principles of the invention.

The retainer element 46 is shown in FIG. 8 and is formed in a circular stepped configuration including a ledge 136 having a flat upper surface 138. A circular riser 140 extends upward from the ledge 136 and is formed with a flat upper surface 142. A cylindrical opening 144 is formed through the retainer element 46 in an axial direction and is formed with a diameter which is essentially the same as the outside diameter of the upper section 66 of the end bodies 40 and 42.

Figure 11:
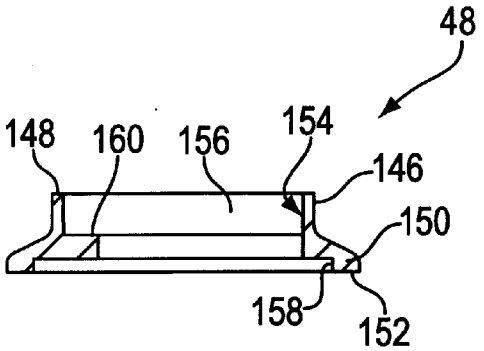
FIG. 11 is a sectional view showing the trim flange of FIG. 9 in accordance with certain principles of the invention.
Figure 10:
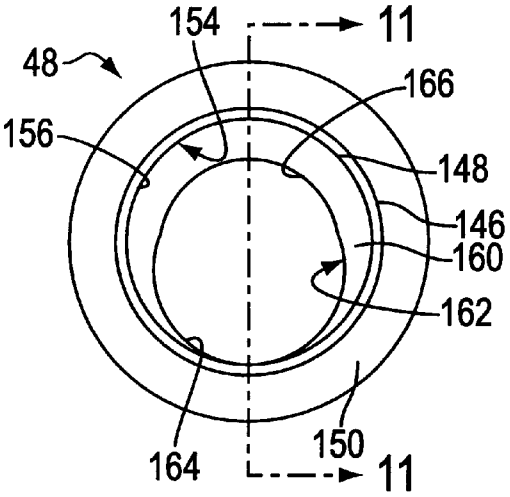
FIG. 10 is a top view showing the trim flange of FIG. 9 in accordance with certain principles of the invention.
Figure 9:
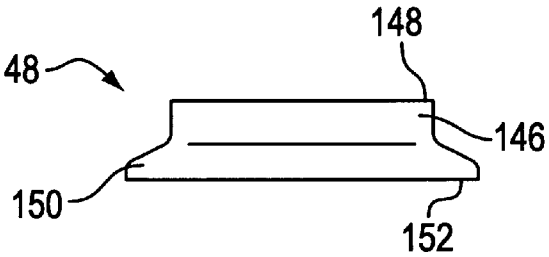
FIG. 9 is a side view showing a trim flange in accordance with certain principles of the invention.

As shown in FIGS. 9 and 11, the trim flange 48 is formed externally with an upper section 146 having a cylindrical shape which extends from a top axial end 148 to its integral junction with a lower section 150 of the flange which flares radially outward and downward to a bottom axial end 152. As shown in FIGS. 10 and 11, the trim flange 48 is formed internally with a passage 154 which extends through the flange from the top end 148 to the bottom end 152. The portion of the passage 154 which is contiguous with the upper section 146 is formed as a cylindrical chamber 156 of a prescribed diameter, while a lower portion of the lower section 150 is formed as a cylindrical chamber 158 of a diameter greater than the prescribed diameter. The chamber 158 is formed with a diameter essentially equal to the outside diameter of the riser 140 of the retainer element 46, and provides a nest for ultimate receipt of the riser therein.

A platform 160 is formed as an integral part of the trim flange 48 between the chambers 156 and 158. A hole 162 is formed through the platform 160 and is shaped by the overlapping formation of a first circular hole portion 164 of a prescribed diameter and a second circular hole portion 166 of a diameter smaller than the prescribed diameter. The prescribed diameter of the first circular hole portion 164 is essentially the same as the prescribed diameter of top section 65 of the end bodies 40 and 42, while the prescribed diameter of the second circular hole portion 166 is essentially the same as the diameter of the annular groove 72 of the end bodies.

Figure 14:
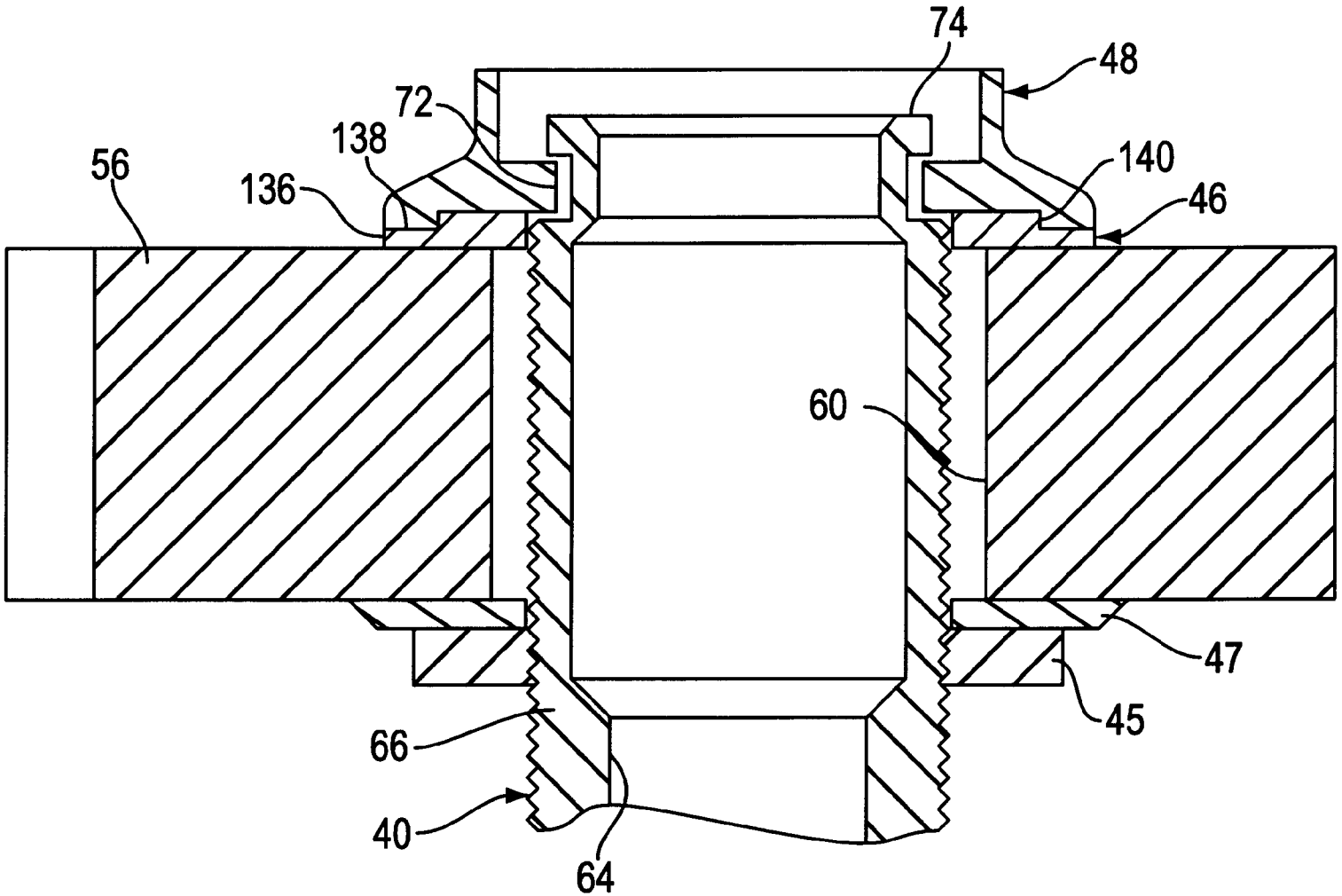
FIG. 14 is a sectional view showing the end body, the retainer, the trim flange and a lock nut in assembly with a deck.

When assembling the components of the faucet assembly 30, the lock nuts 45 are threadedly positioned onto the upper sections 66 of the end bodies 40 and 42, and are moved to a position adjacent the intermediate section 68 as shown in FIG. 1. The washers 47 are then positioned over the upper sections 66 and are moved to engagement with the top of the lock nuts 45. The underbody 36 is then maneuvered to axially align the end bodies 40 and 42 with the holes 60 and 62 of the deck 56, and the underbody is moved toward the underside of the deck. The end bodies 40 and 42 are moved into the holes 60 and 62 to the extent that the top section 65, the annular groove 72 and a small upper portion of the upper section 66 of each end body extends above the top surface of the deck 56 as shown in FIGS. 2 and 14.

In the description below, since the end bodies 40 and 42 are identical, since the retainer elements 46 and 50 are identical, and since the trim flanges 48 and 52 are identical, only the assembly steps of the end body 40, the retainer element 46 and the trim flange 48 will be described. However, it is to be understood that the end body 42, the retainer element 50, and the trim flange 52 are assembled in the same manner.

Figure 12:
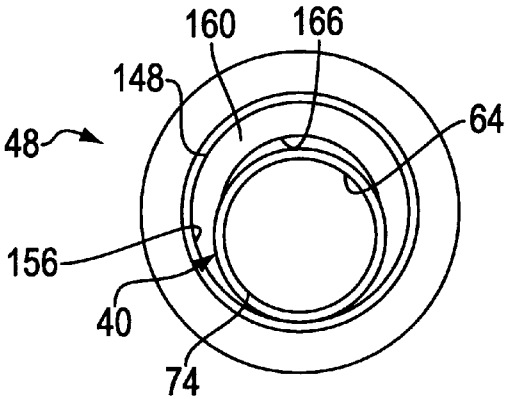
FIG. 12 is a top view showing the trim flange of FIG. 9 in preliminary assembly with an end body in accordance with certain principles of the invention.

The retainer element 46 is then positioned over the extend upper end of the end body 40 with the underside of the element resting on the upper surface of the deck 56. Referring to FIG. 12, the trim flange 48 is then manipulated so that the larger first circular hole portion 164 thereof is aligned axially with the extended portion of the end body 40. The trim flange 48 is then moved downward to allow the extended portion of the upper section 66 to be located in the larger first circular hole portion 164. Eventually, the underside of the trim flange 48 rests on the upper surface 138 of the ledge 136 of the retainer element 46 and the riser 140 thereof nests in the chamber 158 of the trim flange. At this juncture in the assembly, the annular groove 72 of the end body 40 is aligned laterally with the platform 160 of the trim flange 48. It is noted that the axial height of the annular groove 72 is essentially the same as the axial height of the platform 160

Figure 13:
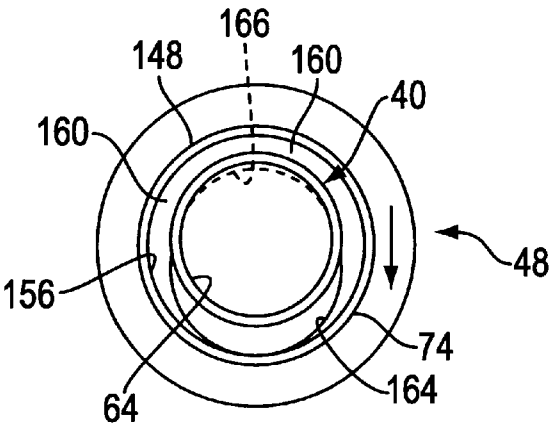
FIG. 13 is a top view showing the trim flange of FIG. 9 in final assembly with the end body of FIG. 12 in accordance with certain principles of the invention.

Referring to FIG. 13, the trim flange 48 is then moved in the direction of the arrow whereby the portion of the platform 160, which is adjacent with the smaller second circular hole portion 166, is moved fully into the annular groove 72 to the extent allowed by the radial depth of the groove. This arrangement now precludes any axial movement of the end body 40. Thereafter, the washer 47 is moved axially over the upper section 66 of the end body 40 and is positioned against the underside of the deck 56. The lock nut 45 is then threadedly moved toward the underside of the deck 56 and eventually engages the washer 47 and is tightened in this position. With the end body 42, the retainer element 50, the trim flange 52, and the respective washer 47 and lock nut 45 assembled in the same manner, the underbody 36 is now firmly secured with the deck 56 with the center body 38 being below and in axial alignment with the center hole 58 formed in the deck.

It is noted that this assembly process is performed with relative ease and efficiency. It is also noted that the sensitive shank 34 was not in place during the assembly of the underbody 36, the retainer elements 46 and 50, and the trim flanges 48 and 52 with the deck 56. Thus, the assembly of these components could take place without concern for damage to the shank 34.

Referring to FIG. 15, the spout 32 and the shank 34 are located above the deck 56 and axially aligned with the center body 38 with the four-sided configuration of the third section 110 of the shank being aligned with the four-sided configuration of the opening 86 of the center body. The third section 110 of the shank 34 is moved into and through the axial passage 76 of the center body 38 from the first axial end 78 thereof, and eventually through and beyond the opening 86 as shown in FIG. 2. In this position, the O-ring 120 is located near the bottom of the center body chamber 82 and the O-ring 126 is located near the top of the center body chamber 84. The transaxial passages 122 of the shank 34 are aligned with the transaxial passages 96 of the center body 38 eventually to allow the flow of fluid therethrough.

When assembling the shank 34 with the center body 38, the bottom of the spout 32 will rest on the top of the deck 56. Due to manufacturing tolerances in making the various components of the faucet assembly 30 such as, for example, the spout 32, the shank 34 and the center body 38, the axial length of the shank is controlled in manufacturing thereof. This results in a clearance gap 168 in the bottom of the chamber 84 of the center body 38 to insure that the bottom of the shank does not engage the bottom of the chamber 84 before the bottom of the spout 32 seats onto the top of the deck 56.

Thereafter, the fastener nut 54 is threadedly assembled with the threaded portions of the third section 110 of the shank 34 to firmly secure the spout 32 and the shank 34 with the underbody 36 and the deck 56. This completes the assembly of the components of the faucet assembly 30 which is now firmly secured to the deck 56.

During assembly of the shank 34 with the center body 38, the shank is maneuvered from the top of the deck where it can be easily manipulated by the installer and readily inserted into the center body 38. The installer does not have to initially install the spout 32 and the shank 34 with the deck 56, and thereby avoids potential damage to the sensitive shank during assembly of the underbody 36 with the deck.

It is noted that the assembly process could be performed in sequences other than the sequence described above without departing from the spirit and scope of the invention.

The structure of the components of the faucet assembly 30 as described above facilitate an easy and efficient assembly of the components in a time-saving process.

In general, the above-identified embodiments are not to be construed as limiting the breadth of the present invention. Modifications, and other alternative constructions, will be apparent which are within the spirit and scope of the invention as defined in the appended claims.

What is claimed is:

1. A faucet assembly, which comprises:

a body formed with a first threadless fastening structure;

a flange formed with a second threadless fastening structure;

the first threadless structure and the second threadless structure being complementary in structure to facilitate retention of the body and the flange together, upon assembly thereof; and the second threadless structure comprising:

a passage formed through the flange and having an interior wall with a prescribed passage transaxial dimension;

a platform formed in the passage and extending radially inward from the interior wall; and a hole portion formed axially through the platform with a transaxial dimension less than the prescribed passage transaxial dimension.

2. A faucet assembly, which comprises:

a body formed with a first threadless fastening structure;

a flange formed with a second threadless fastening structure;

the first threadless structure and the second threadless structure being complementary in structure to facilitate retention of the body and the flange together, upon assembly thereof; and wherein the first threadless structure comprises:

a section at one end of the body formed with an external prescribed transaxial dimension; and a groove formed in the body located adjacent the section and formed with a groove transaxial dimension which is less than the prescribed transaxial dimension of the section; and wherein the second threadless structure comprises:

a passage formed through the flange and having an interior wall with a transaxial dimension greater than the prescribed transaxial dimension of the section;

a platform formed in the passage and extending radially inward from the interior wall; and a hole portion formed axially through the platform with a transaxial dimension less than the prescribed transaxial dimension of the section.

3. The faucet assembly as set forth in claim 2, which further comprises:

the transaxial dimension of the hole portion being greater than the transaxial dimension of the groove.

4. The faucet assembly as set forth in claim 2, wherein the hole portion is a first hole portion formed through the platform about an axis of the flange formed with a first hole portion transaxial dimension, which further comprises:

a second hole portion having a second transaxial dimension formed through the platform in communication with the first hole portion about an axis which is offset from the axis of the flange; and the second hole portion being formed with a second hole portion transaxial dimension which is greater than the first hole portion transaxial dimension.

5. The faucet assembly as set forth in claim 4, which further comprises:

the second hole portion transaxial dimension being greater than the prescribed transaxial dimension of the section; and the first hole portion transaxial dimension being greater than the groove transaxial dimension.

6. A faucet assembly, which comprises:

a body formed with a first threadless fastening structure;

a flange formed with a second threadless fastening structure;

the first threadless structure and the second threadless structure being complementary in structure to facilitate retention of the body and the flange together, upon assembly thereof; and a retainer located about the body and nested in the flange to retain the body in alignment with the axis of the flange.

7. The faucet assembly as set forth in claim 6, which further comprises:

an axial opening formed in the retainer for receipt axially of a segment of the end body adjacent the groove;

an exterior ledge formed at a first end of the retainer;

a riser formed at a second end of the retainer which is joined with and extends from the exterior ledge; and the exterior ledge being formed at a ledge diameter and the riser being formed at a riser diameter which is less than the ledge diameter.

8. The faucet assembly as set forth in claim 7, which further comprises:

the flange formed with an end surface;

a chamber formed in the end surface of the flange;

the riser of the retainer located snugly in the chamber of the flange to retain the end section and the groove of the end body in axial alignment with the axis of the first circular hole portion of the flange.

9. A faucet assembly, which comprises:

an end body formed with an end section having a prescribed exterior diameter;

an annular groove formed in the end body adjacent the end section thereof having a groove diameter less than the prescribed exterior diameter;

a flange formed about an axis thereof with a circular hole portion having a hole portion diameter less than the prescribed exterior diameter and greater than the groove diameter;

a platform formed on the flange fully enclosing about the circular hole portion; and the flange in threadless assembly with the end body wherein portions of the platform which are adjacent the circular hole portion being located within the groove.

10. A faucet assembly, which comprises:

an end body formed with an end section having a prescribed exterior diameter;

an annular groove formed in the end body adjacent the end section thereof having a groove diameter less than the prescribed exterior diameter;

a flange formed about an axis thereof with a first circular hole portion having a hole portion diameter less than the described exterior diameter and greater than the groove diameter;

a platform formed on the flange about the first circular hole portion;

the flange in threadless assembly with the end body wherein portions of the platform which are adjacent the first circular hole portion being located within the groove;

the flange formed with a second circular hole portion in the platform about an axis spaced from the axis of the flange and in communication with the first circular hole portion; and the second hole portion being formed with a diameter which is greater than the prescribed exterior diameter.

11. The faucet assembly as set forth in claim 10, wherein the end section of the end body is a first end section, which further comprises:

the end body formed with a second end section spaced axially from the first end section; and a portion of the end body between the groove and the second end section being formed with threads.

12. The faucet assembly as set forth in claim 11, which further comprises:

a segment of the end body between the groove and the second section of the end body being located within a passage formed in a deck having a first major surface and a second major surface spaced from the first major surface;

the first end section and the groove of the end body located outside the passage of the deck adjacent the first major surface thereof;

the flange in threadless assembly with the end body outside the passage of the deck adjacent the first major surface thereof; and a threaded fastening element in threaded engagement with the threads of the end body outside the passage of the deck adjacent the second major surface thereof.

13. The faucet assembly as set forth in claim 12, which further comprises:

a retainer located about the end body and between the flange and the first major surface of the deck.

14. The faucet assembly as set forth in claim 13, which further comprises:

an axial opening formed in the retainer for receipt axially of the segment of the end body adjacent the groove;

an exterior ledge formed at a first end of the retainer;

a riser formed at a second end of the retainer which is joined with and extends from the exterior ledge; and the exterior ledge being formed at a ledge diameter and the riser being formed at a riser diameter which is less than the ledge diameter.

15. The faucet assembly as set forth in claim 14, which further comprises:

the flange formed with an end surface which is adjacent to and faces the first major surface of the deck;

a chamber formed in the end surface of the flange;

the riser of the retainer located snugly in the chamber of the flange to retain the end section and the groove of the end body in axial alignment with the axis of the first circular hole portion of the flange.

16. The faucet assembly as set forth in claim 15, which further comprises:

the ledge of the retainer being located between the end surface of the flange and the first major surface of the deck.

* * * * *